United States Patent [19]

Kilmartin, III

[11] Patent Number: 4,964,520

[45] Date of Patent: Oct. 23, 1990

[54] DISPLAY ASSEMBLY

[75] Inventor: John D. Kilmartin, III, Providence, R.I.

[73] Assignee: International Packaging Corporation, Pawtucket, R.I.

[21] Appl. No.: 390,521

[22] Filed: Aug. 7, 1989

[51] Int. Cl.[5] ..... A47F 3/14

[52] U.S. Cl. ..... 211/131; 211/13; 211/163

[58] Field of Search ..... 211/194, 13, 188, 131, 211/128, 129, 144, 163

[56] References Cited

U.S. PATENT DOCUMENTS

| | | | |
|---|---|---|---|
| 2,157,400 | 5/1939 | Cooper | 211/129 X |
| 3,498,471 | 3/1970 | Dirkx | 211/131 |
| 3,674,229 | 7/1972 | Keeler | 211/188 X |
| 4,026,417 | 5/1977 | Streim et al. | 211/131 X |
| 4,099,627 | 7/1978 | Strada | 211/194 X |
| 4,322,007 | 3/1982 | Feibelman | 211/13 X |
| 4,614,272 | 9/1986 | Shelton et al. | 211/13 X |
| 4,736,856 | 4/1988 | Alneng et al. | 211/131 |
| 4,822,118 | 4/1989 | Watkins | 211/131 X |
| 4,826,261 | 5/1989 | Nademlejnsky | 211/194 X |

FOREIGN PATENT DOCUMENTS

| | | | |
|---|---|---|---|
| 2208013 | 8/1973 | Fed. Rep. of Germany | 211/131 |

*Primary Examiner*—David L. Talbott
*Assistant Examiner*—Daniel Hulseberg
*Attorney, Agent, or Firm*—Salter & Michaelson

[57] ABSTRACT

A display assembly includes first and second tray members, each including a body portion and a central tubular portion, first and second peripheral support rims on the tray members, respectively, and a tubular central support post. The central support post is received in snug engagement in the interior of the tubular portion of the first tray member and on the exterior of the tubular portion of the second tray member for supporting the second tray member in upwardly spaced relation to the first tray member. The display assembly can be effectively utilized for supporting items for display on the support rims thereof and it can be adapted to meet the needs of various retailers by varying the number of tray members and support posts.

6 Claims, 2 Drawing Sheets

DISPLAY ASSEMBLY

BACKGROUND AND SUMMARY OF THE INVENTION

The instant invention relates to retail display apparatus and more particularly to a display assembly for effectively and attractively displaying items, such as jewelry items, in a retail display.

Various types of apparatus have been heretofore available for supporting jewelry items, such as earrings and pins, in retail displays. For example, various types of display panels which have been adapted for supporting jewelry display cards thereon have been heretofore available. Free standing display stands which have included one or more substantially horizontal bars for receiving and supporting jewelry display cards have also been heretofore available. However, heretofore the prior art relating to jewelry display apparatus has generally failed to provide an effective and compact display assembly which can be easily and economically manufactured and nevertheless adapted to meet the needs of various different retailers.

The instant invention provides an effective display assembly which can be economically manufactured and readily adapted to meet the needs of different retailers. More specifically, the display assembly of the instant invention is preferably adapted for use in displaying jewelry items, such as earrings or pins and it comprises a first tray member, first support means for receiving and supporting an article for display on the first tray member, a second tray member, second support means for receiving and supporting an article for display on the second tray member, and a support post received on the first tray member and operative for supporting the second tray member in upwardly spaced relation to the first tray member. The first and second tray members each include a central tubular portion and each of the tubular portions is formed so that the inner side thereof defines an upwardly opening recess having a lower portion of reduced dimension, an upper portion of enlarged dimension and an inner shoulder therebetween. Each of the tubular portions is further formed so that the outer side thereof defines a downwardly projecting hub having a lower portion of reduced dimension, an upper portion of enlarged dimension and an outer shoulder therebetween. The support post is preferably of tubular configuration and it includes opposite first and second end portions, with the first end portion being snugly received in the upper portion of the recess in the first tray member so that it abuts the inner shoulder therein. The second end portion of the support post is snugly received on the lower portion of the hub of the second tray member so that it abuts the outer shoulder thereon for supporting the second tray member in upwardly spaced relation to the first tray member. The first and second tray members are preferably of substantially identical configuration and the support means on the first and second tray members are preferably formed as upstanding peripheral rims thereon. Further, each of the tray members preferably comprises a body portion which extends downwardly and outwardly around the tubular portion thereof and each of the tray members is preferably integrally formed from a substantially rigid plastic sheet material. The support post and the tubular portions of the tray members are preferably of substantially cylindrical tubular configuration and the display assembly preferably further comprises rotatable turntable means for rotatably supporting the jewelry display assembly on a supporting surface.

It has been found that the display assembly of the instant invention can be effectively utilized for a wide variety of display applications. In this regard, a plurality of the tray members can be effectively assembled with a plurality of support posts to provide a multi-tiered display assembly which is relatively compact and nevertheless adapted for supporting a relatively large number of items, such as jewelry items mounted on display cards. Further, by selecting the correct number of tray members and support posts, the display assembly can be effectively adapted to meet the needs of various different retailers. Still further, when the first tray member is supported on a rotatable turntable the entire display assembly can b rotatably supported on a supporting surface. Still further, because of the relatively simple structures of the tray members and the support posts, the display assembly can be manufactured relatively economically.

Accordingly, it is a primary object of the instant invention to provide an effective display assembly which can be adapted to meet the needs of various different retailers.

Another object of the instant invention is to provide a display assembly which can be easily assembled at point of use and which can be effectively utilized for displaying items, such as jewelry items mounted on display cards.

An even further object of the instant invention is to provide an effective display assembly which can be economically manufactured.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
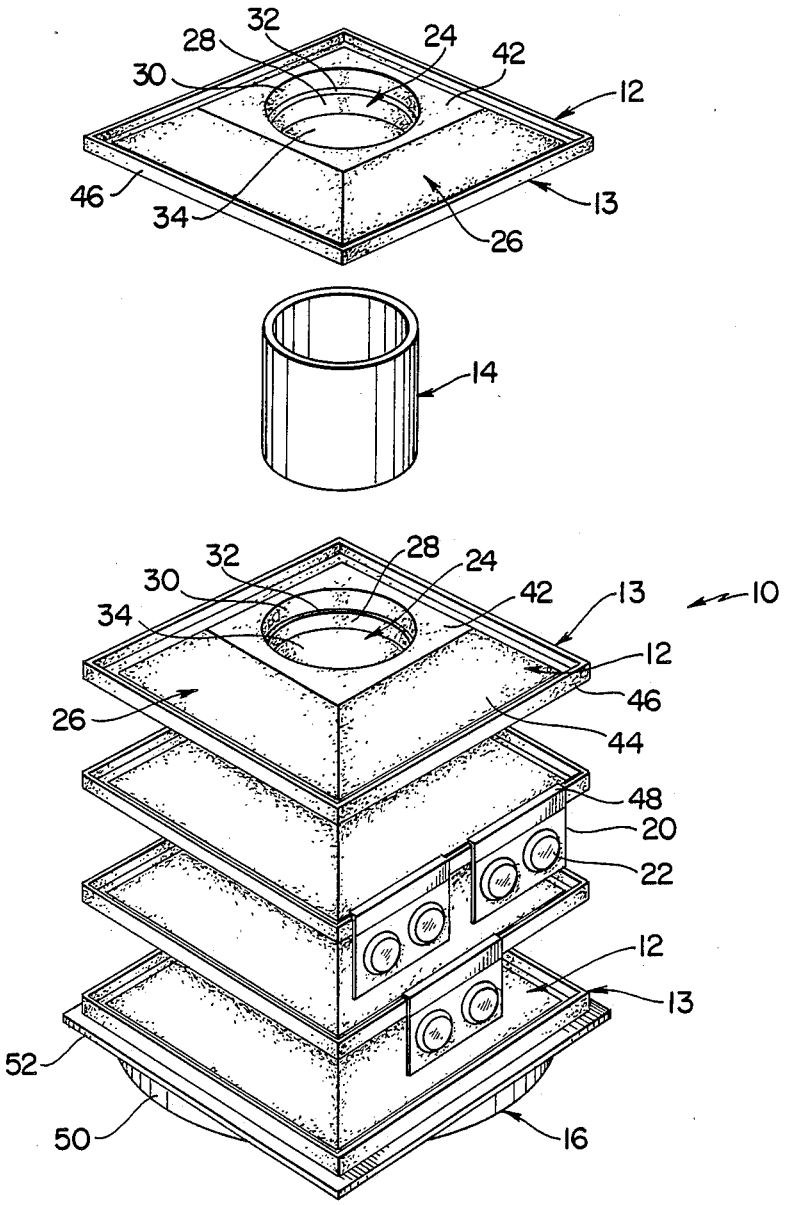
FIG. 1 is an exploded perspective view of the display assembly of the instant invention and FIG. 2 is a partially exploded side elevational view thereof shown partially in section.
Figure 2:
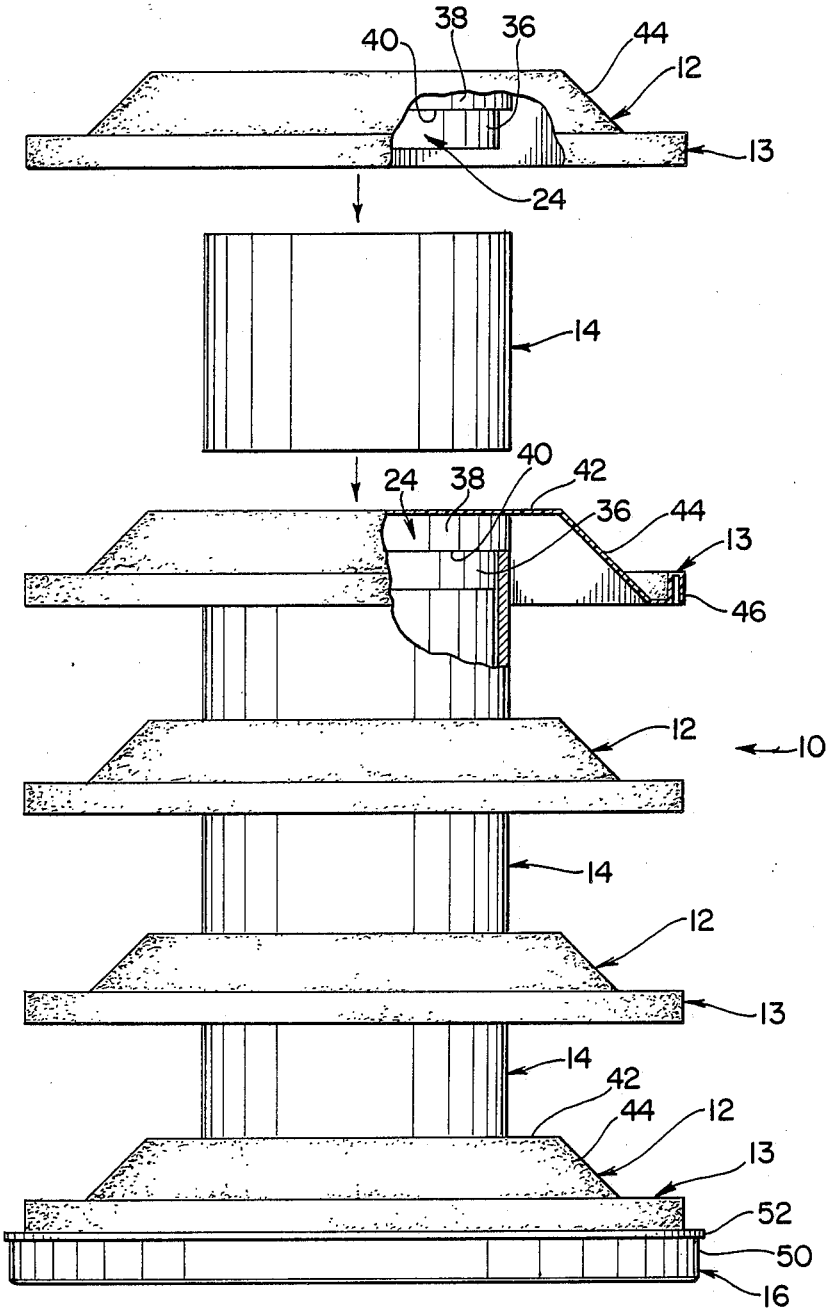

Referring now to the drawings, the display assembly of the instant invention is illustrated in FIGS. 1 and 2 and generally indicated at 10. The display assembly 10 comprises a plurality of tray members generally indicated at 12 having peripheral support rims 13 thereon, a plurality of support posts generally indicated at 14, and a turntable assembly generally indicated at 16. As illustrated, the support posts 14 are assembled between the tray members 12 for interconnecting the tray members 12 so that they are supported one above another in the display assembly 10. The lowermost tray member 12 is received and supported on the turntable assembly 16 which rotatably supporting the jewelry display assembly 10 on a supporting surface. The display assembly 10 is adapted for receiving and supporting a plurality of display cards 20 having jewelry items, such as earrings 22, thereon so that the display cards 20 and the earrings 22 can be attractively and effectively displayed to potential purchasers.

The tray members 12 are preferably each integrally formed from a suitable substantially rigid plastic sheet material and each includes a central tubular portion generally indicated at 24 and a body portion generally indicated at 26. The tubular portion 24 of each of the tray members 12 defines a substantially circular, upwardly opening recess having a lower portion 28 of reduced diameter, an upper portion 30 of enlarged diameter, and a shoulder 32 between the lower and upper portions 28 and 30, respectively, thereof. As herein embodied, the tubular portion 24 of each of the tray members 12 includes a terminal end wall 34, although other embodiments of the display assembly 10 which include tray members having open ended tubular portions are contemplated. The outer side of the tubular portion 24 of each of the tray members 12 includes a lower portion 36 of reduced dimension, an upper portion 38 of increased dimension and a shoulder 40 between the lower and upper portions 36 and 38, respectively, thereof. The body portion 26 of each of the tray members 12 includes a substantially flat, horizontal, central portion 42 of preferably substantially square configuration and a plurality of side portions 44 which extend angularly, downwardly and outwardly from the central portion 42 thereof. The side portions 44 of the tray members 12 preferably extend downwardly by amounts which are at least equivalent to the downward extents of the respective tubular portions 24 thereof so that the tubular portions 24 are effectively concealed by the side portions 44.

Each of the support rims 13 is integrally formed with the tray member 12 thereof so that it extends around substantially the entire perimeter of the tray member 12. Each of the support rims 13 is formed as an upwardly extending rim or lip and each includes an outer facing 46. Each of the support rims 13 is adapted and dimensioned for receiving and supporting a plurality of jewelry display cards, such as the display cards 20 thereon. In this regard, the display cards 20 are preferably of conventional construction and each preferably includes an upper hanger portion 48 which is receivable on a hanger member, such as one of the rim portions 13, for supporting the display card 20 in the manner illustrated in FIG. 1. Each of the rim portions 13 is preferably dimensioned so that the hanger portion 48 of a conventional display card 20 is receivable in snug fitting relation thereon for releasably retaining the display card 20 on the display assembly 10.

Each of the support posts 14 is preferably of tubular configuration and each is dimensioned so that one end portion thereof is receivable in snug engagement in the upper portion 30 f the interior of the tubular portion 24 of a first tray member 12 with the adjacent terminal end of the support post 14 in engagement with the shoulder 32 on the first tray member 12. Each of the support posts 14 is further dimensioned so that the opposite end portion thereof is receivable in snug engagement on the reduced lower portion 36 of the outer side of the tubular portion 24 of a second tray member 12 with the adjacent terminal end of the support post 14 received in engagement with the shoulder 40. Accordingly, one or more tray members 12 can be assembled with a plurality of support posts 14 to form a multi-tiered display assembly wherein the precise number of tray members 12 and support posts 14 is selected to meet the needs of a particular retailer.

The turntable assembly 16 is of conventional construction and it includes a substantially circular lower portion 50 which is received on a base (not shown) it is rotatable relative to the base. The turntable assembly 16 further comprises an upper plate 52 which is secured to the upper side of the lower portion 50 so that it is rotatable therewith above the base (not shown) of the turntable assembly 16. The lowermost tray member 12 is preferably secured to the upper plate 52, such as with a suitable adhesive, so that it is permanently attached to the turntable assembly 16 and rotates with the upper plate 52.

It is seen therefore that the instant invention provides an effective display assembly which can be made in relatively inexpensive constructions and which can be adapted to meet the needs of various retailers. The tray members 12 and the support rims 13 are preferably integrally molded from a suitable plastic sheet material so that they can be inexpensively made in production quantities. The support posts 14 are preferably made from a suitable substantially rigid sheet material, such as cardboard, and hence they are also adapted to be economically manufactured in large quantities. Further, the support posts 14 and the tray members 12 are adapted to be quickly and easily assembled to form a display assembly which meets the needs of a specific application. Accordingly, for these reasons as well as the other reasons hereinabove set forth, it is seen that the display assembly of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A display assembly comprising a pair of tray members, and a support post for maintaining said tray members in vertically spaced relation, each of said tray members having top and bottom sides and including a support means for receiving and supporting an article for display thereon, and a central cylindrical tubular portion, each of said tubular portions comprising a main portion including inner and outer sides having inner and outer diameters, respectively, a terminal end portion including inner and outer sides having inner and outer diameters, respectively, and a shoulder portion therebetween; and outer diameters of the main portion of each of said tubular portions being greater than the inner and outer diameters, respectively, of the terminal end portion thereof, said support post being of elongated tubular cylindrical configuration and having inner and outer sides having substantially uniform inner and outer diameters, the inner diameter of the main portion of each of said tubular portions being substantially the same as the outer diameter of said support post, the outer diameter of the terminal and portion of each of said tubular portions being substantially the same as the inner diameter of said support post; said support post having opposite first and second end portions, the outer side of the first end portion of said support post being received in engagement with the inner side of the main portion of the tubular portion of one of said tray members so that it abuts the shoulder portion thereof; the outer side of the terminal end portion of the tubular portion of the other of said tray members being received in engagement with the inner side of the second end portion of said support post so that the second end portion of said support post abuts the shoulder portion of the tubular portion in which the second end portion is received for maintaining said tray members in vertically spaced relation.

2. In the display assembly of claim 1, said tray members being substantially identical.

3. In the display assembly of claim 1, the support means of each of said tray members comprising an upstanding peripheral rim thereon.

4. In the display assembly of claim 1, the tubular portion of each of said tray members extending downwardly, each of said tray members further comprising a body portion which extends downwardly and outwardly around the respective tubular portion thereof, each of said support means comprising an upstanding peripheral rim on the respective body portion thereof.

5. The display assembly of claim 1 further comprising turntable means for rotatably supporting said display assembly on a supporting surface.

6. In the display assembly of claim 1, each of said tray members being integrally formed with the respective support means thereof from a substantially rigid plastic sheet material.

* * * * *